United States Patent [19]

Van Wignsberghe, deceased et al.

[11] 4,075,022

[45] Feb. 21, 1978

[54] AQUEOUS DISPERSIONS OF PHOTOGRAPHIC INGREDIENTS

[76] Inventors: Leo August Van Wignsberghe, deceased, late of 's-Gravenwezel, Belgium, by Agnes Maria Zinzen, heir, Fazantenlaan 13, B 2232 's-Gravenwezel, Belgium; Raphael Karel Van Poucke, Ringlaan 22, B 2600 Berchem, Belgium; Jaak Pieter Van Vugt, Esmoreitlaan 3, B 2050 Antwerpen, Belgium

[21] Appl. No.: 673,370

[22] Filed: Apr. 5, 1976

[30] Foreign Application Priority Data

Apr. 3, 1975 United Kingdom ..... 13784/75

[51] Int. Cl.[2] ..... G03C 1/40; G03C 1/02

[52] U.S. Cl. ..... 96/100 R; 96/94 R; 96/114.7; 106/135; 260/118; 424/300

[58] Field of Search ..... 96/100, 94 R, 114.4, 96/111, 114.7; 260/463, 117, 118; 424/300; 106/135, 136, 137

[56] References Cited

U.S. PATENT DOCUMENTS 3,554,755 1/1971 Rinauro ..... 96/94 R 3,567,455 3/1971 Seelig et al. ..... 96/114.4

3,926,631 12/1975 Arai et al. ..... 96/100

FOREIGN PATENT DOCUMENTS 1,214,664 4/1966 Germany ..... 260/463

*Primary Examiner*—J. Travis Brown

*Attorney, Agent, or Firm*—A. W. Breiner

[57] ABSTRACT

Hydrophilic colloid compositions are described which may form part of a light-sensitive silver halide element, the said compositions comprising a dihalo- or trihaloethylcarbonate of the formula

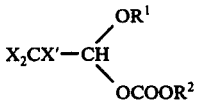

wherein X is halogen, X′ is halogen or hydrogen and each of $R^1$ and $R^2$ are an alkyl or aryl group, in order to inhibit growth of bacteria and fungi, to protect the hydrophilic colloid against degeneration and/or to improve the stability of dispersed photographic ingredients.

25 Claims, No Drawings

AQUEOUS DISPERSIONS OF PHOTOGRAPHIC INGREDIENTS

The present invention relates to hydrophilic colloid compositions, more particularly hydrophilic colloid compositions comprising uniformly distributed therein substances (hereafter called "photographic ingredients") which are destined to be incorporated in a layer of a photographic material, i.e. a radiation sensitive or non-radiation sensitive material for use in photography.

In the manufacture of photographic materials various types of ingredients are employed which have to be incorporated in the material, usually in one or more hydrophilic colloid layers. Among the various types of ingredients which are thus used (depending in each case on the nature of the photographic material and its intended use) are coloured as well as colourless colour couplers, competing couplers, mask-forming compounds, dyes, e.g. filter dyes, antihalation dyes and sensitizing dyes, stabilizers, UV-absorbers, anti-oxidizing agents, etc.

It is known to incorporate photographic ingredients in hydrophilic colloid coating compositions by means of dispersion techniques using high-boiling water-insoluble organic solvents known as oil-formers e.g. dibutyl phthalate and tricresyl phosphate and/or low-boiling, volatile water-insoluble or sparingly water-soluble organic solvents e.g. ethyl acetate, diethyl carbonate, methylene chloride, and chloroform. For this purpose the photographic ingredient e.g. colour coupler is dissolved in the low-boiling and/or high-boiling solvent and the solution is emulsified in extremely fine droplets into an aqueous medium usually with the aid of one or more surface active agents. Whereas the high-boiling organic solvent remains in the medium, the low-boiling organic solvent is removed by evaporation.

The aqueous medium may be a hydrophilic colloid coating composition for forming one of the hydrophilic colloid layers of a photographic silver halide element but in common practice is mere water or a mere aqueous solution of hydrophilic colloid e.g. gelatin in order to lay in a stock of the aqueous medium containing the photographic ingredients homogeneously distributed therein from which, according to need parts are taken for admixture with the hydrophilic colloid coating compositions e.g. silver halide emulsions.

The above dispersion techniques present a number of problems. The photographic ingredients tend to crystallize and the crystallized particles may grow and agglomerate and thus give rise to flocculation. Moreover, the aqueous media when stored are subject to biological growth of bacteria and fungi and to degeneration of gelatin, if present, which markedly reduces storage life.

It has now been found that improved dispersions of photographic ingredients in aqueous media are obtained by adding to the aqueous medium before, during or after dispersing the photographic ingredient therein, a dihalo- or trihalo-ethylcarbonate of the formula:

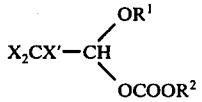

wherein:

X is halogen, more particularly chlorine, bromine or fluorine

X′ is hydrogen or has the same significance as X, and each of $R^1$ and $R^2$, which may be the same or different, is alkyl; preferably $C_1$–$C_5$ alkyl, aryl e.g. phenyl, or substituted aryl.

The carbonates of the above formula not only inhibit growth of bacteria and fungi in aqueous media containing photographic ingredients and protect at least to some extent the hydrophilic colloid, more particularly gelatin, against degeneration, but also have a favourable effect on the particle size distribution of dispersed photographic ingredients. It was further found that these carbonates can be used as high-boiling solvents (oil-formers) for incorporating photographic ingredients in aqueous media. They have higher solvent action, at least for many photographic ingredients than conventionally used oil-formers e.g. dibutyl phthalate and tricresyl phosphate so that the stability of emulsified droplets of the carbonate and the photographic ingredient in aqueous media is improved. When dispersions of photographic ingredients in aqueous media containing these carbonates are subsequently incorporated in coating compositions for forming a silver halide emulsion layer or another hydrophilic colloid layer of a photographic silver halide material, the carbonates have no or no noteworthy disadvantageous effect on the photographic properties.

The present invention, as broadly defined, includes any hydrophilic colloid composition, more particularly a gelatin composition containing at least one carbonate of the above formula. An example of such hydrophilic colloid composition is a hydrophilic colloid coating composition for forming a hydrophilic colloid layer of a photographic silver halide element or a hydrophilic colloid composition for addition to such hydrophilic colloid coating composition.

The present invention also includes any photographic silver halide element comprising one or more hydrophilic colloid layers including one or more radiation-sensitive silver halide emulsion layers wherein at least one of said layers is a hydrophilic colloid composition containing a carbonate corresponding to the above general formula.

The present invention further includes a method of forming a hydrophilic colloid composition which comprises adding a carbonate corresponding to the above formula to an aqueous solution of the hydrophilic colloid.

The present invention is particularly concerned with hydrophilic colloid compositions and photographic elements comprising a hydrophilic colloid layer wherein the hydrophilic colloid comprises uniformly distributed therein a photographic ingredient and a carbonate of the above formula.

The hydrophilic colloid composition comprising uniformly distributed therein a carbonate of the above formula and a photographic ingredient, is preferably made according to the present invention by the steps of forming a solution of the photographic ingredient in an organic solvent or mixture of organic solvents, dispersing the solution in an aqueous medium, optionally comprising a hydrophilic colloid with the aid of one or more surface active compounds as dispersing agent(s), and — at least if the aqueous medium does not comprise a hydrophilic colloid — mixing the aqueous medium with an aqueous hydrophilic colloid composition, wherein the photographic ingredient is dispersed in the aqueous medium in the presence of a carbonate corresponding to the above general formula. The aqueous medium can be mere water or a mere solution of hydrophilic colloid e.g. aqueous gelatin, which are subsequently admixed with another hydrophilic colloid composition (e.g. a silver halide emulsion) for forming a final coating composition ready for application to form a hydrophilic colloid layer of a photographic material, such as a silver halide element. However, the aqueous medium to which the carbonate is initially added may be such that it forms a said final hydrophilic colloid coating composition once the said ingredient has been dispersed therein.

When carrying out the present invention, a said carbonate of the foregoing formula may be used as a high-boiling solvent (oil former) for a photographic ingredient to be dispersed in an aqueous medium, or as part of a solvent mixture for such ingredient. An alternative procedure within the scope of the invention is to add the carbonate to the aqueous medium separately, e.g. before or at the stage of dispersing a solution of the said ingredient in the aqueous medium or after the dispersion has been made.

The carbonates of the above formula can be prepared as described by Böhme and Budde, Arch. Pharmaz. 305, 629 (1972) by reaction of di- or trihaloacetaldehyde hemiacetals or of bromal or chloral hydrate with chloroformic acid esters in the presence of tertiary bases e.g. triethylamine.

Representative examples of compounds corresponding to the above general formula are:

1. methyl(1-methoxy-2,2,2-trichloroethyl)carbonate
2. ethyl(1-ethoxy-2,2,2-trichloroethyl)carbonate
3. methyl(1-ethoxy-2,2,2-trichloroethyl)carbonate
4. methyl(1-isopropoxy-2,2,2-trichloroethyl)carbonate
5. methyl(1-n-butoxy-2,2,2-trichloroethyl)carbonate
6. phenyl(1-ethoxy-2,2,2-trichloroethyl)carbonate
7. methyl(1-ethoxy-2,2-dichloroethyl)carbonate
8. methyl(1-methoxy-2,2,2-trifluoroethyl)carbonate
9. ethyl(1-ethoxy-2,2,2-trifluoroethyl)carbonate
10. methyl(1-methoxy-2,2,2-tribromoethyl)carbonate The invention is particularly valuable for forming hydrophilic colloid compositions more particularly silver halide emulsions comprising dispersed therein hydrophobic photographic couplers and mask-forming compounds. By photographic coupler is meant colour couplers which in silver halide photography couple with oxidized aromatic primary amino colour developing agents to form dye images as well as competing couplers which couple with such developing agents to form colourless compounds (see e.g. British patent specification No. 861,138). By mask-forming compound is meant a compound which oxidatively couples with a photographic coupler in an oxidizing bleaching bath to form a coloured mask image (see e.g. British patent specification Nos. 880,862 and 975,932) as well as coloured colour couplers which upon coupling with the oxidized colour developing agent split off an azogroup (see e.g. U.S. Pat. No. 2,584,349).

The carbonates, when used as oil-formers in preparing the aqueous dispersions of the couplers or mask-formers in aqueous media from which they are incorporated in silver halide emulsions, prevent the diffusion of the couplers and mask-formers into adjacent water-permeable layers. However, the couplers and mask-formers remain sufficiently accessible to the developing and other processing solution to enable the usual methods of processing to be applied. This is proved by the high colour densities obtained or colour development of emulsion layers comprising colour couplers incorporated therein from aqueous dispersions of the couplers and the carbonates of the above formula.

The invention can also be applied for the formation of light-sensitive or non-light-sensitive hydrophilic colloid layers of a photographic material containing photographic ingredients other than colour couplers and mask-formers e.g. filter dyes, antihalation dyes and light-screening dyes, developing agents, stabilizers, sensitizing dyes, UV-absorbers, fluorescing compounds, antioxidizing agents, etc.

The method of the invention can also be used to form hydrophilic colloid layers containing mixtures of different photographic ingredients e.g. mixtures of different colour couplers, colour couplers and mask-formers, colour couplers and antioxidizing agents, etc.

The photographic ingredients which are dispersed in aqueous media in admixture with the carbonates of the above formula generally have a solubility in water of at most 3% by weight at room temperature (20° C).

In accordance with the present invention the carbonates can be used in widely varying concentration. Very low amounts, e.g. amounts as low as 0.01% by weight relative to the weight of the aqueous medium, suffice to inhibit biological growths and these amounts already have a favourable effect on the particle size distribution of dispersed photographic ingredients. When used as high-boiling solvent in the preparation of the aqueous dispersions of photographic ingredients they can be used e.g. in amounts between about 0.1 and about 10 preferably between about 0.5 and about 2 parts by weight relative to the amount of photographic ingredient.

According to a preferred embodiment of the method of the present invention, the photographic ingredient is dispersed in aqueous medium by the steps of forming a solution of the photographic ingredient and the carbonate in an auxiliary organic solvent or mixture of solvents, dispersing the solution formed in the aqueous medium in the presence of one or more surface active agents, and if necesary removing the auxiliary solvent(s) leaving thereby droplets of the carbonate containing the photographic ingredient uniformly distributed in the aqueous medium.

The auxiliary solvents are preferably water-insoluble or sparingly water-soluble solvents having a boiling point of at most 150° C and a solubility in water of at most 25% by weight at 20° C e.g. diethyl carbonate, methylene chloride, methyl formate, ethyl formate, n-butyl formate, methyl acetate, ethyl acetate, n-propyl acetate, isopropyl acetate, butyl acetate, methyl propionate, ethyl propionate, carbon tetrachloride, sym.-dichloroethane, trichloroethylene, 1,2-dichloropropane, chloroform, amyl chloride, methyl ethyl ketone, diethyl ketone, methyl n-propyl ketone, diisopropyl ether, cyclohexane, methyl cyclohexane, ligroin (boiling range: 60:110° C), benzene, toluene, xylene and nitromethane, or mixtures of these solvents.

The auxiliary solvents include also high-boiling as well as low-boiling water-soluble solvents e.g. methanol, ethanol, isopropyl alcohol, dimethylsulphoxide, tetrahydrofuran, N-methylpyrrolidone, dioxan, acetone, butyrolactone, ethylene glycol, ethylene glycol monoethyl ether, ethylene glycol monoethyl ether, ethylene glycol monobutyl ether, diethylene glycol monoethyl ether, diethylene glycol monoethyl ether, glycerol, acetonitrile, formamide, dimethyl formamide diacetone alcohol, 1,1-tetrahydrothiophene dioxide and dimethoxyethane, or mixtures of these solvents.

It is also possible of course to use mixtures of water-insoluble or sparingly water-soluble solvents and water-soluble solvents.

It is further possible to use in addition to the carbonate one or more conventional oil-formers i.e. high-boiling water-insoluble solvents e.g. phthalic acid esters such as dibutyl phthalate and phosphoric acid esters such as tricresyl phosphate.

During or after having dispersed the organic solution comprising carbonate and photographic ingredient into the aqueous medium e.g. with the aid of a homogenizer, a colloid mill or an ultransonic wave generator, the auxiliary solvent(s) is (are) preferably removed from the aqueous medium. This removal is generally effected by evaporation, occasionally by applying reduced pressure e.g. a pressure from 10 mm to 500 mm Hg and/or moderate heating, preferably not higher than 80° C. Thus, the auxiliary solvents preferably have a vapour pressure so that they can be removed readily from the dispersion by applying a reduced pressure of 10 mm to 500 mm Hg at a temperature between 20° and 80° C. High-boiling water-soluble solvents having too high a vapour pressure to be removed in this way can be left in the dispersion of carbonate and photographic ingredient in the aqueous medium from which they are incorporated into the hydrophilic colloid composition for forming a layer of a photographic material, if they have no disadvantageous effect on the physical or photographic properties. However, they can be removed from the hydrophilic colloid composition by washing the chilled and thereby gelled colloid composition.

The amount of organic solution of carbonate and photographic ingredient which is dispersed in the aqueous medium may vary within wide limits. If it is the intention to incorporate the photographic ingredient directly in the coating composition of the hydrophilic colloid layer of the photographic element the amount is dependent on the desired concentration of the photographic ingredient in the colloid layer. However, if it is the intention to create stocks of the aqueous media e.g. mere water or aqueous gelatin comprising dispersed therein droplets of carbonate and photographic ingredient, higher amounts can be added so that relatively concentrated dispersions can be stored. In general about 1 volume of organic solution is dispersed in 1 to 20 volumes of aqueous medium.

The use of preformed stock dispersions in water or an aqueous hydrophilic colloid offers an excellent reproducibility since it is possible to incorporate the photographic ingredients into the photographic colloid coating compositions always in the same concentration and with the same degree of dispersion. Moreover, where photographic ingredients for incorporation in light-sensitive silver halide emulsions are involved it is advantageous to form first a dispersion in a non-light-sensitive aqueous medium because in that case excessive agitation of the light-sensitive emulsion, which could cause fog, can be avoided. Also, auxiliary solvents that could be harmful when present in hydrophilic colloid coatings of a photographic element can be removed from the preformed aqueous media before the latter are admixed with the coating composition.

The organic solution of carbonate and photographic ingredient is emulsified in the aqueous medium in the presence of one or more surface active agents. The surface active agent(s) can be added already at the step of forming the solution of carbonate and photographic ingredient but they can also be added only at the stage of emulsifying the organic solution in the aqueous medium. Alternatively, the same or different surface active agents can be used at both stages.

The surface-active agents used may be of the ionic, non-ionic or amphoteric type. Examples of suitable ionic surface active agents are: the sodium salt of oleyl methyl tauride, sodium stearate, 2-heptadecenyl-benzimidazole-5-sulphonic acid sodium salt, sodium sulphonates of aliphatic alcohols containing more than 5 carbon atoms per molecule, e.g. 2-methylhexanol sodium sulphonate; the sodium salt of di-isooctyl ester of sulphonated succinic acid, sodium dodecyl sulphate and p-dodecylbenzene sulphonic acid sodium salt. Examples of suitable non-ionic emulsifying agents are saponine, condensation products of ethylene oxide and alkyl phenols, e.g. p-octylphenol and p-isononyl phenol and phenylethylene glycol oleate. Other examples of anionic and non-ionic surface active agents can be found in British patent application No. 13017/73.

A survey of emulsifying agents and wetting agents, representatives of which can be used in the method of the present invention are described by Gerhard Gawalek "Wasch- und Netzmittel" Akademieverlag, Berlin (1962).

It is also possible to use mixtures of anionic and non-ionic surface active agents as described e.g. in British patent application No. 13017/73.

Although in the present invention the use of gelatin as hydrophilic colloid is favoured, other water-soluble colloidal materials or mixtures of them can be used too, e.g. colloidal albumen, starch, zein, alginic acid and derivatives e.g. salts, esters and amides, casein, a cellulose derivative such as carboxymethyl cellulose, a synthetic hydrophilic colloid such as polyvinyl alcohol or poly-N-vinyl pyrrolidone, anionic polyurethans, copolymers of acrylic esters, acrylonitrile and acrylamides, etc.

The photographic elements according to the present invention contain the carbonate in at least one photographic hydrophilic colloid layer which may contain light-sensitive silver halide grains or not, preferably in a silver halide emulsion layer containing a photographic dye forming coupler. Dye forming couplers that can be used together with the carbonates of the above general formula include any of the common couplers that react with the oxidation products of colour developing agents to form cyan, magenta and yellow dye images. For the formation of the cyan image it is common practice to use couplers derived from phenol and $\alpha$-naphthol; for the formation of the magenta image usually couplers are used derived from 2-pyrazolin-5-one and indazolone, and for the formation of the yellow image couplers derived from $\beta$-ketocarboxylic acid derivatives are used e.g. benzoylacetanilide couplers and pivaloylacetanilide couplers. As known in the art the couplers can comprise substituents at the coupling position which split off upon colour development and the split off compounds include those having a development inhibiting effect e.g. as in the so-called DIR-couplers. The carbonates of the above formula have been found to be particularly suitable for use together with 4-equivalent as well as 2-equivalent ketomethylene colour couplers for yellow e.g. ketomethylene couplers the active methylene group of which may be substituted by heterocyclic groups of the type described in the published German Patent Applications DOS Nos. 1,800,420, 2,163,812, 2,213,461, 2,057,941, 2,329,587, etc. and in British patent application Nos. 314/75 and 35,223/75.

In the colour development the common aromatic primary amino developing substances can be used. Suitable developing agents are more particularly p-phenylene diamine and derivatives thereof e.g. N,N-dialkyl-p-phenylene diamines, the sulphonamido substituted p-phenylene diamines disclosed in U.S. Pat. No. 2,548,574 and other substituted p-phenylene diamines disclosed in U.S. Pat. No. 2,566,271.

Typical examples of p-phenylenediamines are N,N-diethyl p-phenylene diamine, 2-amino-5-diethylaminotoluene, N-butyl-N-sulphobutyl-p-phenylene diamine, 2-amino-5-[N-ethyl-N(β-methylsulphonamido)ethyl]aminotoluene, N-ethyl-N-β-hydroxyethyl-p-phenylenediamine, etc. These developing agents are used usually in their salt form such as the hydrochloride or sulphate.

The following examples illustrate the present invention.

EXAMPLE 1

5 g of the yellow-forming colour coupler corresponding to the formula:

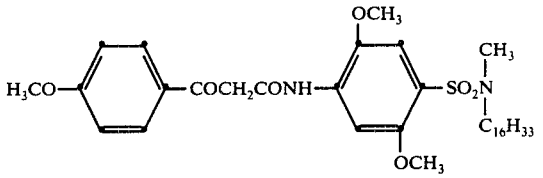

were dissolved in a mixture of 2 ml of ethyl acetate and 3 g of carbonate No. 2 in the list hereinbefore given.

The solution formed was dispersed by means of a high speed stirrer in 30 ml of a 10% aqueous gelatin solution comprising 3 ml of a 10% aqueous solution of sodium dodecylbenzene sulphonate.

Upon removal of the ethyl acetate at 55° C and reduced pressure, water was added to make 600 ml.

The gelatin dispersion obtained was stored for later admixture with a silver halide emulsion to form a blue-sensitive silver halide emulsion layer of a photographic multicolour material. The stored dispersion could be kept for more than 6 months without degeneration of the gelatin.

EXAMPLE 2

The yellow-forming colour couplers A and B corresponding to the formulae:

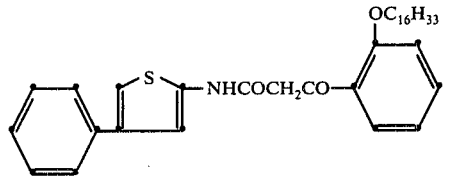

A.

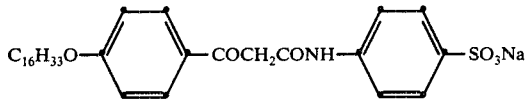

B.

were dissolved at a weight ratio of A to B of 1 g to 10 g in 30 ml of ethylacetate whereupon the solution was dispersed in 75 ml of water containing saponin as dispersing agent.

The dispersion was divided into three aliquot portions and to each portion one of the biocides listed in the following table were added in an amount of 0.03% by weight based on the weight of the dispersion. The ethylacetate was removed by evaporation under reduced pressure at a temperature of 55° C. Aqueous dispersions of the colour couplers were obtained having the following characteristics:

| biocide | particle size distribution | stability before crystallization |
|---|---|---|
| phenol | 50% less than 0.23 μm<br>95% less than 0.55 μm | 3 weeks |
| 2-hydroxymethyl-2-nitro-1,3-propane diol (according to British Patent 1,177,048) | 50% less than 0.20 μm<br>95% less than 0.75 μm | 3 weeks |
| carbonate no. 2 | 50% less than 0.13 μm<br>95% less than 0.28 μm | more than 6 months |

The aqueous dispersions were admixed with a gelatino silver halide emulsion to form a blue-sensitive emulsion layer for a photographic material.

EXAMPLE 3

5 g of the competing coupler corresponding to the formula:

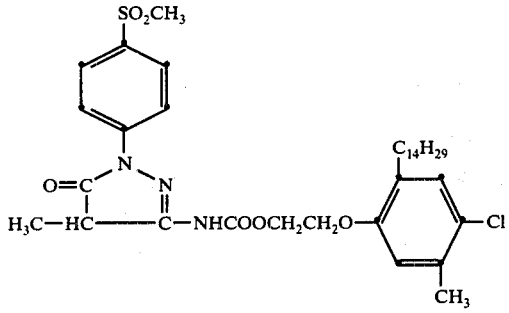

and 5 g of carbonate No. 2 were dissolved in 15 ml of ethyl acetate at 65° C.

The solution was dispersed at 65° C in 30 ml of water comprising 5 ml of a 10% aqueous solution of sodium oleyl methyl tauride. The ethyl acetate was removed by evporation at 55° C under reduced pressure leaving a dispersion in water of the competing coupler.

The dispersion was stored for later admixture with an aqueous gelatin solution to form an intermediate galatin layer in a photographic multilayer colour material.

The stored dispersion remained stable for more than 1 week whereas a dispersion made under identical circumstances but without carbonate No. 2 was stable for only 24 hours.

EXAMPLE 4

5 g of the cyan-forming colour coupler corresponding to the formula:

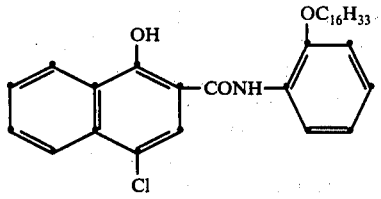

and 5 g of carbonate No. 2 were dissolved in 20 ml of ethyl acetate.

The solution was dispersed at 55° C in 35 ml of water comprising 3 ml of a 20% aqueous solution of Mersolat H (trade name of Farbenfabriken Bayer A. G., Leverkusen, W. Germany for an alkane sulphonate made by sulphochlorination and subsequent saponification of a mixture of saturated branched-chain as well as straight-chain hydrocarbons averaging 14 C-atoms obtained by hydrogenation of the so-called Kogasins, which are the hydrocarbon mixtures distilling in the range of 230°–320° C formed according to the Fisher-Tropsch hydrocarbon synthesis). The ethyl acetate was removed by evaporation at 55° C under reduced pressure leaving a dispersion in water of the colour coupler. The aqueous dispersion was stored for later admixture with a red-sensitized silver halide emulsion to form a cyan-forming emulsion layer on a photographic multilayer colour material. The stored dispersion remained stable without crystallization for more than 1 month.

EXAMPLE 5

2 g of the yellow-forming colour coupler A and 5 g of the yellow-forming colour coupler B

A:

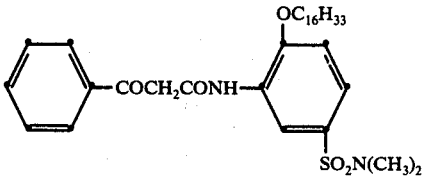

B:

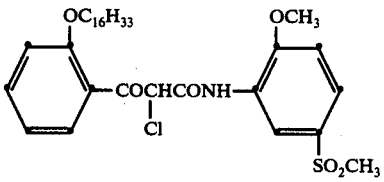

were dissolved in 12 ml of ethyl acetate and 7 g of carbonate No. 2.

The solution was dispersed at 65° C in 58 ml of water comprising 7 ml of a 10% aqueous solution of sodium oleyl methyl tauride.

After removal of the ethyl acetate at 50° C and under reduced pressure, an aqueous dispersion of the colour couplers was obtained which was stored for later admixture with a blue-sensitive silver halide emulsion. The stored dispersion remained stable for more than three months whereas a dispersion made under identical circumstances but without compound 2 remained stable for only 24 hours.

EXAMPLE 6

5 g of the yellow forming colour coupler B of Example 5 and 5 g of carbonate No. 2 were dissolved in 25 ml of ethyl acetate.

The solution was dispersed at 65° C in 35 ml of water comprising 5 ml of a 10% aqueous solution of sodium oleyl methyl tauride.

After removal of the ethyl acetate under reduced pressure at 55° C an aqueous dispersion of the colour coupler was obtained which was stored for later admixture with a blue-sensitive silver halide emulsion layer. The stored dispersion remained stable for more than 3 months.

EXAMPLE 7

A conventional blue-sensitive silver bromoiodide emulsion was divided into two aliquot portions.

To portion I an aqueous gelatin dispersion prepared as described in Example 1 was added so that the emulsion portion comprised about 0.006 mole of coupler per kg of silver halide emulsion.

To portion II a gelatin dispersion was added, which was prepared as described in Example 1 but with the difference that no carbonate No. 2 was used. The amount of gelatin dispersion added was also such that the emulsion portion comprised 0.006 mole of coupler per kg of silver halide emulsion.

The emulsion portions were coated on a conventional film support and dried. After exposure through a step-wedge, the emulsions were developed in a developing composition comprising 2-amino-5-[N-ethyl-N(β-methylsulphonylamino)ethyl]aminotoluene sulphate as developing agent, to form negative silver images and yellow dye images.

The silver images and residual silver halide were removed by treatment with a sodium bichromate bleach and a sodium thiosulphate fixer.

The following sensitometric results were obtained:

| emulsion | fog | relative speed | Dmax |
|---|---|---|---|
| I | 0.15 | 105 | 2.85 |
| II | 0.13 | 100 | 2.76 |

The above results show that the presence of carbonate No. 2 in the coupler dispersion has no noteworthy effect on the sensitometric characteristics and colour coupling activity.

We claim:

1. A hydrophilic colloid composition comprising a carbonate of the formula:

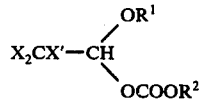

wherein:

X represents a halogen atom

X' represents a hydrogen atom or a halogen atom, and each of $R^1$ and $R^2$ represents an alkyl group or an aryl group.

2. A composition according to claim 1, wherein in the general formula for the carbonate X and X' are chlorine.

3. A composition according to claim 1, wherein the carbonate is ethyl(1-ethoxy-2,2,2-trichloroethyl)carbonate.

4. A composition according to claim 1, wherein the hydrophilic colloid is gelatin.

5. A composition according to claim 1, wherein the composition comprises radiation-sensitive silver halide.

6. A composition according to claim 1, wherein the composition comprises a photographic ingredient other than radiation-sensitive silver halide suitable for use in photographic silver halide material.

7. A composition according to claim 6, wherein the photographic ingredient is a photographic coupler or mask-forming compound.

8. A composition according to claim 1, wherein the composition is a hydrophilic colloid layer of a photographic silver halide material.

9. Composition according to claim 8, wherein the said layer is a layer of a photographic multilayer colour material comprising a photographic coupler capable of oxidative coupling with an aromatic primary amino colour developing agent.

10. Method of forming a hydrophilic colloid composition wherein a carbonate of the formula:

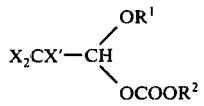

wherein:

X represents a halogen atom

X' represents a hydrogen atom or a halogen atom, and each of $R^1$ and $R^2$ represents an alkyl group or an aryl group, is added to an aqueous solution of the hydrophilic colloid.

11. Method according to claim 10, wherein in the general formula for the carbonate X and X' are chlorine.

12. Method according to claim 10, wherein the carbonate is ethyl(1-ethoxy-2,2,2-trichloroethyl)carbonate.

13. Method according to claim 10, wherein the hydrophilic colloid is gelatin.

14. Method according to claim 10, wherein the composition comprises radiation-sensitive silver halide.

15. Method according to claim 10, wherein a photographic ingredient is also added to the aqueous solution of hydrophilic colloid.

16. Method according to claim 15, wherein the photographic ingredient is a photographic coupler or mask-forming compound.

17. Method according to claim 15 comprising the steps of forming a solution of the photographic ingredient in an organic solvent or mixture of organic solvents and dispersing the organic solution in an aqueous medium, which may comprise a hydrophilic colloid, with the aid of one or more surface active compounds in the presence of the said carbonate, and — at least if the aqueous medium does not comprise a hydrophilic colloid — mixing the aqueous medium with an aqueous hydrophilic colloid composition.

18. Method according to claim 17, wherein the aqueous medium into which the organic solution of photographic ingredient is dispersed in the presence of the carbonate, is mere water and the aqueous medium is subsequently mixed with an aqueous hydrophilic colloid composition for forming a final coating composition to form a hydrophilic colloid layer of a photographic material.

19. Method according to claim 17, wherein the aqueous medium, into which the organic solution of photographic ingredient is dispersed in the presence of the carbonate, comprises a hydrophilic colloid and the hydrophilic colloid medium comprising the carbonate and photographic ingredient is subsequently mixed with a hydrophilic colloid composition for forming a final coating composition to form a hydrophilic colloid layer of a photographic silver halide material.

20. Method according to claim 17, wherein the carbonate is used as organic solvent or part of an organic solvent mixture for forming the organic solution of the photographic ingredient which is dispersed in the aqueous medium.

21. Method according to claim 17, wherein the carbonate is added to the aqueous medium before, during or after dispersing the organic solution in the aqueous medium.

22. Method according to claim 20, wherein the organic solvent(s) other than the carbonate used in forming the organic solution of the photographic ingredient, is (are) removed during or after dispersing the organic solution in the aqueous medium.

23. Method according to claim 22, wherein the said organic solvent is a water insoluble or sparingly water-soluble solvent.

24. Method according to claim 23, wherein the solvent is ethyl acetate.

25. Method according to claim 15, wherein the said carbonate is used in an amount between about 0.1 and about 10 parts by weight relative to the amount of photographic ingredient.

* * * * *